US010745245B2

(12) United States Patent
Shi et al.

(10) Patent No.: US 10,745,245 B2
(45) Date of Patent: Aug. 18, 2020

(54) GOVERNOR ASSEMBLY AND ELEVATOR

(71) Applicant: Otis Elevator Company, Farmington, CT (US)

(72) Inventors: Zhengbao Shi, Shanghai (CN); Randall S Dube, Glastonbury, CT (US); Yong Zhao, Shanghai (CN); Min Wang, Shanghai (CN); Zhihuan Man, Shanghai (CN); Ye Li, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 372 days.

(21) Appl. No.: 15/662,793

(22) Filed: Jul. 28, 2017

(65) Prior Publication Data

US 2018/0037438 A1 Feb. 8, 2018

(30) Foreign Application Priority Data

Aug. 2, 2016 (CN) ..... 2016 1 0620731

(51) Int. Cl.

| | |
|---|---|
| ***B66B 5/04*** | (2006.01) |
| ***B66B 1/32*** | (2006.01) |
| ***B66B 5/16*** | (2006.01) |
| ***B66B 5/18*** | (2006.01) |

(52) U.S. Cl.

CPC ..... *B66B 5/044* (2013.01); *B66B 1/32* (2013.01); *B66B 5/16* (2013.01); *B66B 5/18* (2013.01)

(58) Field of Classification Search

CPC ..... B66B 5/046; B66B 5/042; B66B 5/044
See application file for complete search history.

(56) References Cited

U.S. PATENT DOCUMENTS

| | | | |
|---|---|---|---|
| 375,396 | A | 12/1887 | Teed |
| 5,005,681 | A | 4/1991 | Pipes |
| 5,363,942 | A | 11/1994 | Osada |
| 5,377,786 | A | 1/1995 | Nakagawa |
| 6,161,653 | A | 12/2000 | Skalski et al. |
| 6,227,334 | B1 | 5/2001 | Yumura et al. |

(Continued)

FOREIGN PATENT DOCUMENTS

| | | | |
|---|---|---|---|
| CN | 101041405 | B | 11/2010 |
| CN | 102892699 | A | 1/2013 |

(Continued)

OTHER PUBLICATIONS

European Search Report for application EP 17184215.6, dated Feb. 23, 2018, 9 pages.

(Continued)

*Primary Examiner* — Diem M Tran
(74) *Attorney, Agent, or Firm* — Cantor Colburn LLP

(57) ABSTRACT

The present invention provides a governor assembly and an elevator, wherein the governor assembly includes: a support; a first axle rotatably supported by the support; a main pulley rotatably mounted on the first axle relative to the first axle; a first guide pulley near the main pulley; a first safety device actuated by the rotation of the first axle; and a centrifugal tripping mechanism which enables, when a rotating speed of the main pulley exceeds a preset value, the main pulley and the first axle to be coupled and rotate together. The governor assembly according to the present invention is of a compact structure and is applicable to a small mounting space.

21 Claims, 7 Drawing Sheets

(56) References Cited

U.S. PATENT DOCUMENTS

| | | | |
|---|---|---|---|
| 7,137,484 | B2 | 11/2006 | Martin |
| 8,342,294 | B2 | 1/2013 | Michaus et al. |
| 9,359,173 | B2 | 6/2016 | Dube |
| 2013/0098711 | A1 | 4/2013 | Aguado et al. |
| 2014/0367206 | A1 | 12/2014 | Della Porta et al. |
| 2015/0136544 | A1 | 5/2015 | Dube et al. |
| 2015/0291390 | A1* | 10/2015 | Kakio ..... B66B 5/0031 187/249 |

FOREIGN PATENT DOCUMENTS

| | | | |
|---|---|---|---|
| CN | 204434018 | U | 7/2015 |
| DE | 4336150 | A1 | 7/1994 |
| EP | 1182163 | A1 | 2/2002 |
| EP | 1535875 | A1 | 6/2005 |
| EP | 1598300 | A1 | 11/2005 |
| EP | 1832542 | A1 | 9/2007 |
| JP | 2006182483 | A | 7/2006 |
| WO | 2016016680 | A1 | 2/2016 |

OTHER PUBLICATIONS

Dynatech, "Star Overspeed Governor" available at: http://www.elevatorequipment.co.uk/files/ww/s2%20man%20star%20overspeed%20governor.pdf, published Jun. 29, 2008, 34 pgs.

* cited by examiner

GOVERNOR ASSEMBLY AND ELEVATOR

FOREIGN PRIORITY

This application claims priority to Chinese Patent Application No. 201610620731.5, filed Aug. 2, 2016, and all the benefits accruing therefrom under 35 U.S.C. § 119, the contents of which in its entirety are herein incorporated by reference.

TECHNICAL FIELD

The present invention relates to the technical field of an elevator governor, and in particular, to a follower-type governor especially suitable for being arranged in a narrow shaft and an elevator having such a governor.

BACKGROUND

A governor for an elevator is known. When a speed of the elevator exceeds a particular range, the governor starts a switch to power off an elevator motor, so that the elevator slows down or brakes. In a special situation in which the elevator continues to speed up, the governor starts a mechanical retarding mechanism, which is usually a safety gear frictionally engaged with a guide rail, so as to slow down the elevator through friction between the safety gear and the guide rail.

In the prior art, there is a "machine room" type governor or a "machine room-less" type governor. The governors are mounted at the top of the shaft or in a top machine room. Such governors may be used at a car side or a counterweight side of the elevator. However, in some special buildings, such governors are not allowed to be mounted due to limitations of site conditions, for example, the top of the elevator shaft has no space for disposing the governor.

The prior art provides a follower-type governor moving along with the car.

SUMMARY OF THE INVENTION

An objective of the present invention is to solve or at least alleviate problems in the prior art.

To solve the foregoing technical problems, the present invention provides a governor assembly and an elevator, wherein the governor assembly includes:

a support;

a first axle rotatably supported by the support;

a main pulley rotatably mounted on the first axle relative to the first axle;

a first guide pulley near the main pulley;

a first safety device actuated by the rotation of the first axle; and a centrifugal tripping mechanism, which enables, when a rotating speed of the main pulley exceeds a preset value, the main pulley and the first axle to be coupled and rotate together.

BRIEF DESCRIPTION OF THE DRAWINGS

The foregoing and other features of the present invention become obvious with reference to the accompanying drawings, wherein.

DETAILED DESCRIPTION OF THE EMBODIMENTS

It is easy to understand that, persons of ordinary skill in the art can propose multiple interchangeable structural manners and implementations without changing the essential spirit of the present invention according to the technical solutions of the present invention. Therefore, the following specific embodiments and the accompanying drawings are merely exemplary descriptions of the technical solutions of the present invention, and should not be considered as all of the present invention or restrictions or limitations to the technical solutions of the present invention.

Orientation terms, such as upper, lower, left, right, before, behind, front, back, top, and bottom, mentioned or probably mentioned in the specification are defined according to structures shown in the accompanying drawings and are relative concepts. Therefore, there may be corresponding changes according to different positions and different usages. Hence, these or other orientation terms should not be interpreted as restrictive terms.

First, a governor assembly according to an embodiment of the present invention and its application at a counterweight side of an elevator are described in detail below with reference to FIG. 1 to FIG. 4. It should be understood that, although the present invention uses an example in which the governor assembly is used at the counterweight side, the governor assembly according to the present invention may also be used at a car side of the elevator.

Figure 1:
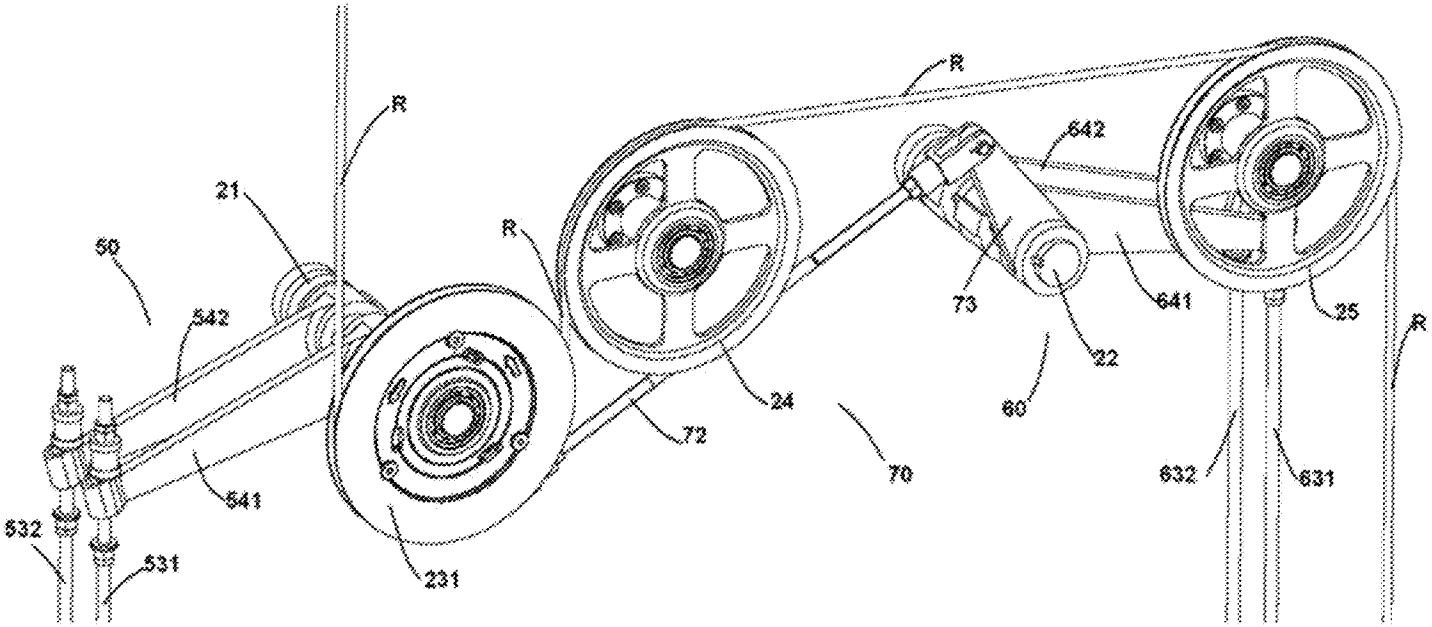
FIG. 1 illustrates a three-dimensional diagram of a governor assembly according to an embodiment of the present invention.

First refer to FIG. 1, which illustrates a schematic diagram of a single governor assembly 200 according to an embodiment of the present invention. The governor assembly 200 includes a main pulley 231 rotatably supported by a first axle 21, a first guide pulley 24, and a second guide pulley 25. FIG. 1 further illustrates an upper actuation part of a first safety device 50 related to the first axle 21 and an upper actuation part of a second safety device 60 moved jointly with the first safety device 50 by using a connecting rod system 70.

Figure 2:
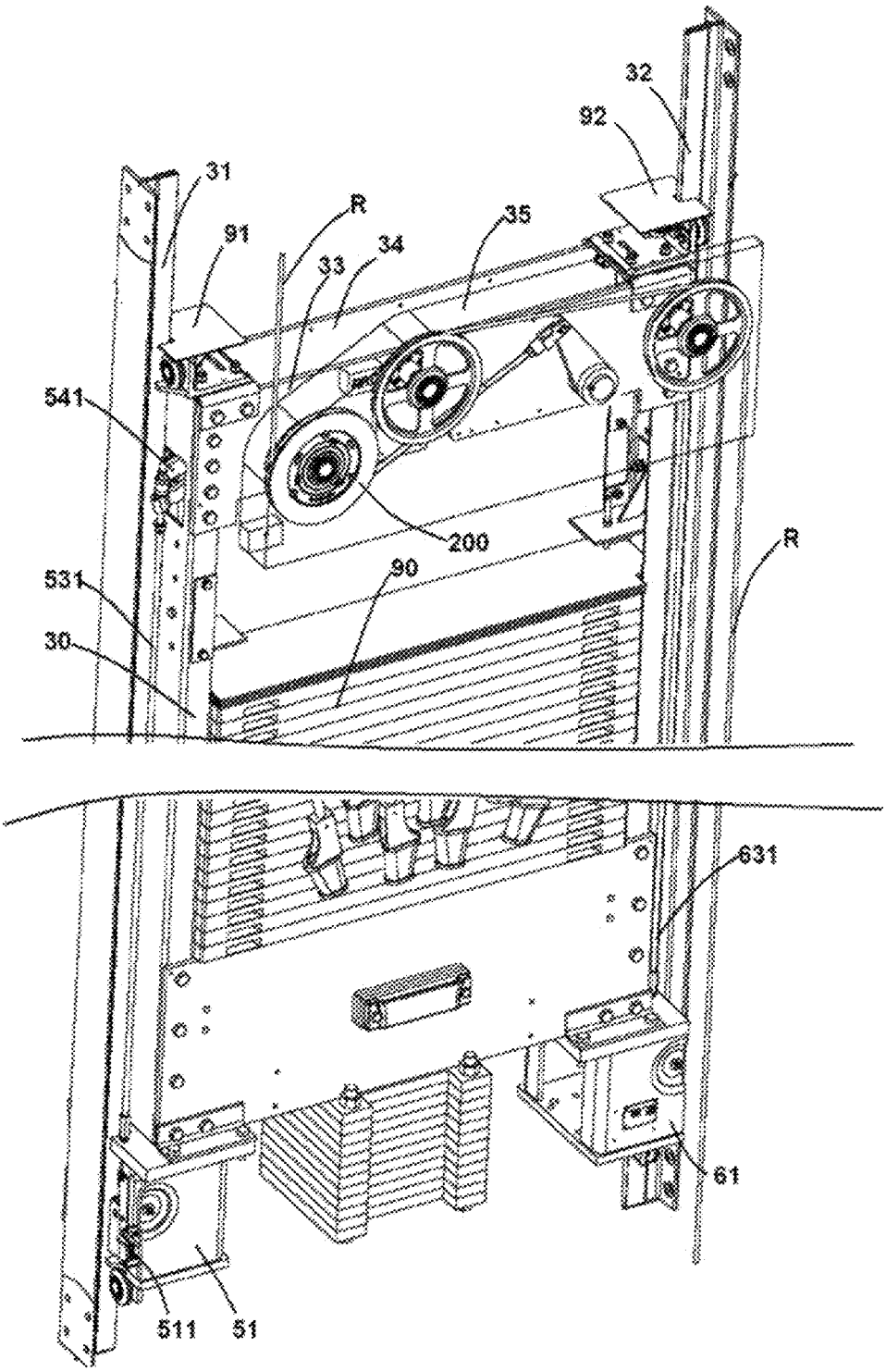
FIG. 2 illustrates a three-dimensional diagram of a governor assembly disposed at a counterweight side of an elevator according to an embodiment of the present invention.

Refer to FIG. 2, which illustrates an application of the governor assembly 200 in FIG. 1 at the counterweight side. It should be understood that, although FIG. 2 illustrates that the governor assembly 200 is disposed at the top of a counterweight rack 30 at the counterweight side, the governor assembly 200 may also be mounted at the bottom or in the middle of the counterweight rack 30 in an alternative embodiment. In an elevator, the counterweight side is also referred to as a balanced side, wherein a counterweight block is configured so as to keep balance with the car.

Generally speaking, to save space, a shaft at the counterweight side is designed to be relatively narrow; the top, the bottom, and the surrounding space of the counterweight side are all rather narrow. Therefore, to configure a follower-type governor at the counterweight side, challenges from the space and power supply need to be overcome.

The counterweight side generally includes: a first guide rail 31 and a second guide rail 32 that are located in a same plane and define a guide rail plane; the counterweight rack 30 moving along the first guide rail 31 and the second guide rail 32 by using multiple guide boots, for example, guide boots 91 and 92 shown in FIG. 2; and multiple counterweight blocks 90 disposed in the counterweight rack 30. FIG. 2 illustrates the governor assembly 200, which is mounted on a support at the top of the counterweight rack 30. For example, in the embodiment shown in FIG. 2, the support is a pair of opposite supports at the top of the counterweight rack 30, including a first support 33 and a second support 34. The first support 33 and the second support 34 substantially extend in a direction parallel to the guide rail plane where the first guide rail 31 and the second guide rail 32 are located, and the first support 33 and the second support 34 are substantially flush with a long side of the counterweight rack or the counterweight block. In the embodiment shown in FIG. 2, the first support 33 and the second support 34 are each in the form of a tablet, but in an alternative embodiment, the support is not limited to the form of a tablet, for example, the support may be a tripod, a rod support, a railing support, or a net support mounted at the top or the bottom of the counterweight rack 30. It should be understood that, persons skilled in the art may design various kinds of supports, provided that the support can support the multiple components. The governor assembly 200 further includes a housing 35, wherein the housing 35 is illustrated to be transparent so that internal components of the governor assembly 200 are visible. The housing 35 at least partially covers main components of the governor assembly 200, such as the main pulley and/or one or more guide pulleys.

Figure 3:
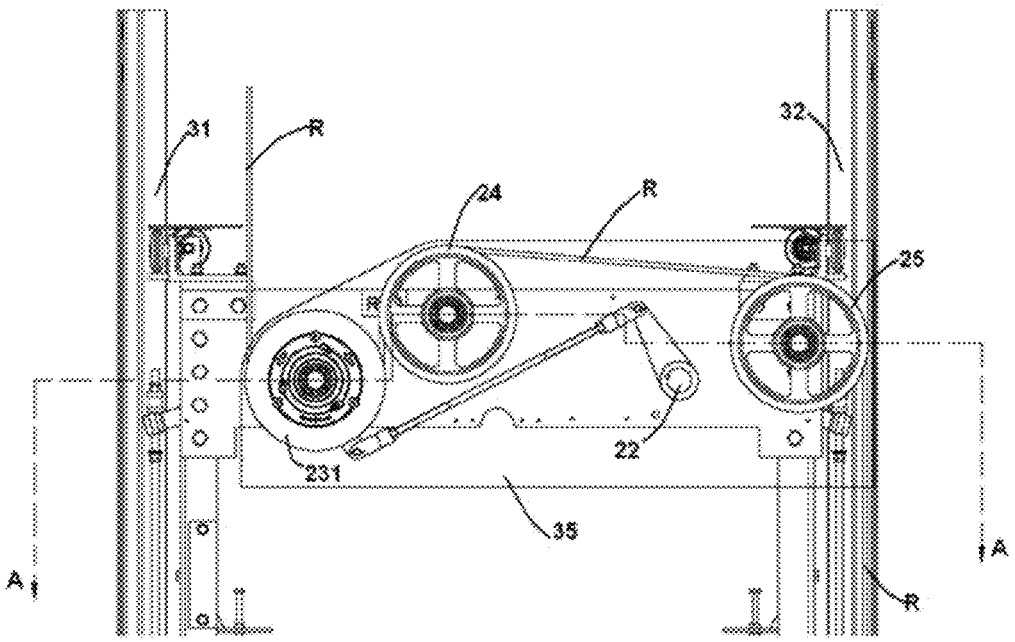
FIG. 3 illustrates a front view of a governor assembly disposed at a counterweight side of an elevator according to an embodiment of the present invention.
Figure 4:
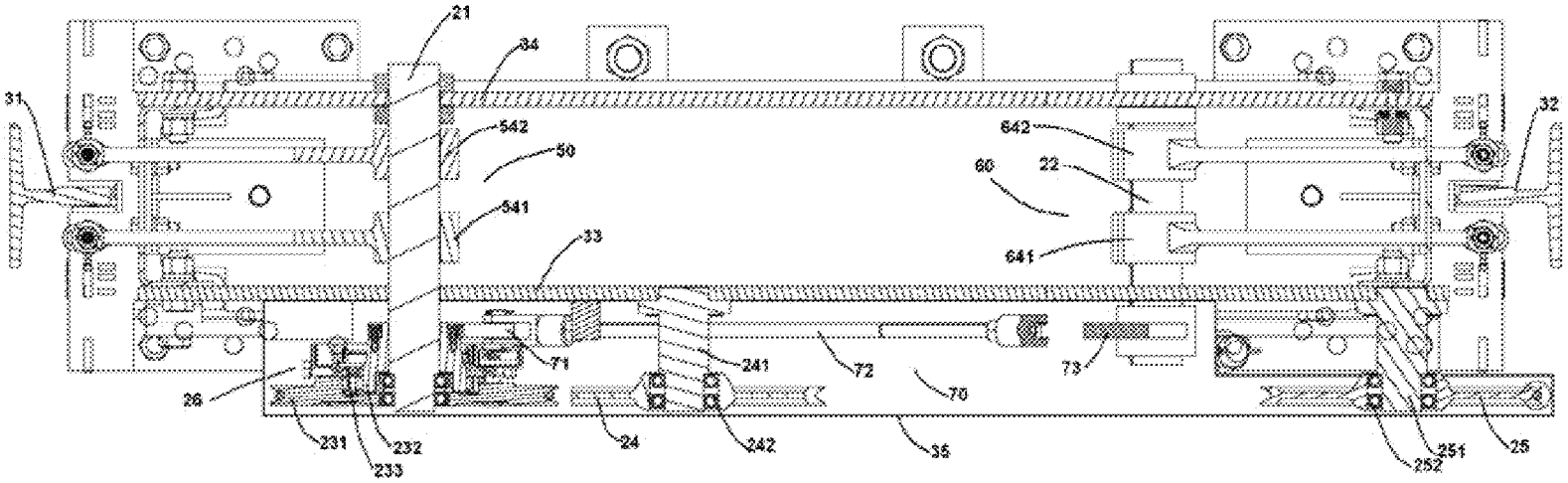
FIG. 4 illustrates a combined sectional view along a broken line A-A in FIG. 3.

Referring to FIG. 3 and FIG. 4 in combination, the governor assembly 200 includes a first axle 21, wherein the first axle 21 is supported by a support. In some embodiments, the support is disposed to be a pair of opposite supports, including a first support 33 and a second support 34. The first support 33 and the second support 34 are substantially parallel to each other, are located opposite to each other at two sides of the first and second guide rails 31 and 32 or the guide rail plane, and both substantially extend in a direction parallel to the guide rail plane where the first guide rail 31 and the second guide rail 32 are located. The first axle 21 passes through holes in corresponding positions on the first support 33 and the second support 34 to be rotatably supported on the first support 33 and the second support 34, for example, the first axle is disposed at a side near the first guide rail 31. The first axle 21 has a middle portion located between the first support 33 and the second support 34, and at least one end portion extending to outer sides of the first support 33 and the second support 34. For example, in some embodiments, the end portion extends from the first support 33 to the outer side of the first support 33. The main pulley 231 is rotatably supported on the end portion of the first axle 21, for example, by using a bearing 234. The first guide pulley 24 is disposed near the main pulley 231, specifically, at a position on the right side of the main pulley 231 and slightly higher than the main pulley 231. The first guide pulley 24 (and the optional second guide pulley 25) and the main pulley 231 are substantially in the same plane; the plane in which the first guide pulley 24 (and the optional second guide pulley 25) and the main pulley 231 are located is parallel to the guide rail plane. The first guide pulley 24 is rotatably supported on a first guide pulley axle 241, for example, the first guide pulley 24 is supported on the first guide pulley axle 241 by using a bearing 242. The first guide pulley axle 241 is mounted only on the first support 33, and extends outwardly from the first support 33. The second guide pulley 25 is disposed near the second guide rail 32 on the other side of the shaft, and may be located at the same side of the main pulley 231 with the first guide pulley 24. The second guide pulley 25 may be rotatably supported by a second guide pulley axle 251 mounted on the first support 33, for example, the second guide pulley is supported by using a bearing 252. Likewise, the second guide pulley axle 251 extends outwardly only from the first support 33. The second guide pulley 25 is used to guide a rope R to suspend near the second guide rail 32, so that the main pulley 231 and the first guide pulley 24 can be arranged in more optional positions. Of course, when the second guide pulley 24 is located near the first guide rail or the second guide rail, the third guide pulley 25 may be omitted.

The main pulley 231, the first guide pulley 24, and the second guide pulley 25 are each provided with a rope groove on the periphery. The rope R is rolled over the main pulley 231, the first guide pulley 24, and the second guide pulley 25 successively along the rope grooves. It is known that, an upper end of the rope R is connected to the top of the shaft, and a lower end of the rope R is connected to the bottom of the shaft or is provided with a heavy object to tighten the rope R. The second guide pulley 25 guides the rope R to suspend near the second guide rail 32. When the counterweight rack 30 moves along the guide rail at a normal speed, the rope R drives, due to friction, the main pulley 231, the first guide pulley 24, and the second guide pulley 25 to rotate about respective support axles, wherein the rotation speeds of the main pulley 231 and the guide pulleys are directly associated with the moving speed of the counterweight rack, and therefore are associated with a moving speed of the car.

In the embodiment of the present invention, a centrifugal tripping mechanism 26 is provided on the first axle 21, and between the main pulley 231 and the first axle 21, so that when a rotating speed of the main pulley 231 exceeds a preset value, the centrifugal tripping mechanism 26 enables the main pulley 231 and the first axle 21 to trip each other and rotate together. That is, when the counterweight rack, for example, is out of control and moves too fast, the main pulley 231 speeds up, and the centrifugal tripping mechanism 26 enables, due to its ever-increasing centrifugal force, the main pulley 231 and the first axle 21 to trip each other and rotate together. At this time, the main pulley 231 drives the first axle 21 to rotate together, so as to actuate a first safety device 50 related to the first axle 21 and further actuate a second safety device 60 optionally by using a connecting rod mechanism 70.

Figure 5:
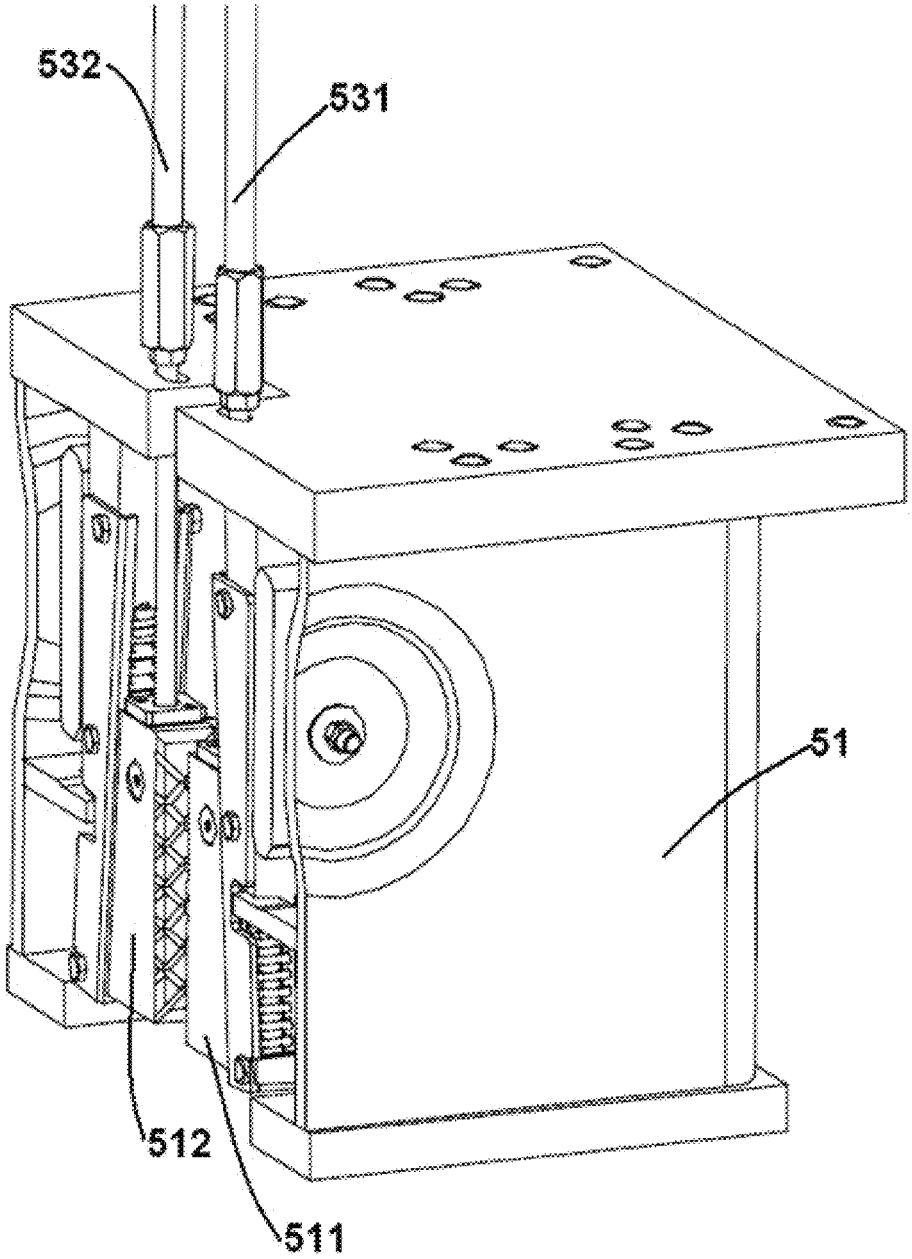
FIG. 5 illustrates a view of an engaging member of a safety device.

In some embodiments, the first safety device 50 includes one or two swing arms, such as a first swing arm 541 and a second swing arm 542, which are located between the first support 33 and the second support 34 and fixedly connected to the first axle 21. First ends of the first swing arm 541 and the second swing arm 542 are fixedly connected to the first axle 21, and second ends of the first swing arm 541 and the second swing arm 542 are connected to corresponding pull rods 531 and 532 respectively. The corresponding pull rods 531 and 532 suspend from two sides of the guide rail 31, and are provided with an engaging device 51 (shown in FIG. 5)

at the bottoms thereof. For example, in one embodiment, the bottoms of the pull rods 531 and 532 are connected to engaging members 511 and 512 respectively, whereas the engaging members 511 and 512 are, for example, in the form of a wedge, and are located at a front side and a rear side of the first guide rail 31 (the first guide rail 31 is not drawn in FIG. 5) respectively. The first safety device 50 is actuated as the first axle 21 rotates; the first swing arm 541 and the second swing arm 542 rotate with the first axle 21 to pull the first pull rod 531 and the second pull rod 532, so that the engaging members 511 and 512 rub against the guide rail 31 to brake the counterweight rack 30. It should be understood that, a safety device of another type may be selected, provided that the safety device can be actuated by the rotation of an axle.

In some embodiments, the governor assembly 200 further includes a second safety device 60, which includes a second axle 22. Similar to the first axle 21, the second axle 22 can also be rotatably supported by both the first support 33 and the second support 33. The second axle 22 includes a middle portion located between the first support 33 and the second support 34, and an end portion extending to an outer side of the first support 33. The end portions of the second axle 22 and the first axle 21 are coupled by using the connecting rod mechanism 70, so that by means of the connecting rod mechanism 70, the second axle 22 is driven to rotate by the rotation of the first axle 21. The connecting rod mechanism 70 may include a first arm 71, a connecting rod 72, and a second arm 73.

The second safety device 60 includes one or two swing arms, such as a third swing arm 641 and a fourth swing arm 642, which are fixedly connected to the middle portions of the first support 33 and the second support 34 of the second axle 22. First ends of the third swing arm 641 and the fourth swing arm 642 are fixedly connected to the second axle 22, and second ends of the third swing arm 641 and the fourth swing arm 642 are connected to corresponding third and fourth pull rods 631 and 632 respectively. The corresponding pull rods 631 and 632 suspend from two sides of the second guide rail 32, and are each provided with an engaging member at the bottom. The engaging members are, for example, in the form of a wedge, and are located at a front side and a rear side of the second guide rail 32 respectively. As the first axle 21 rotates, the second axle 22 is driven to rotate to actuate the second safety device 60; the third swing arm 641 and the fourth swing arm 642 rotate with the second axle 22 to pull the corresponding third and fourth pull rods 631 and 632, so that the engaging members rub against the second guide rail 32 to brake the counterweight rack 30.

Figure 6:
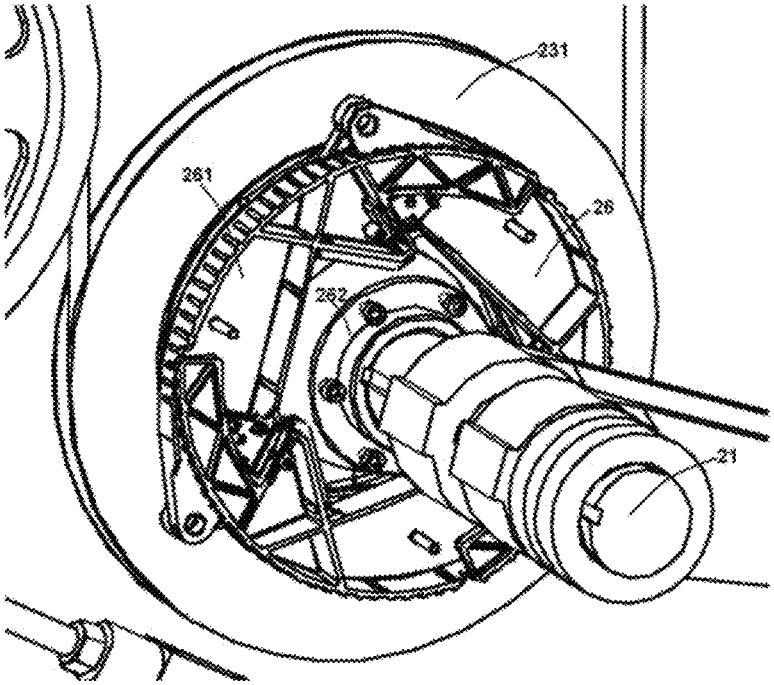
FIG. 6 illustrates a back view of a centrifugal tripping mechanism and a main pulley.

The centrifugal tripping mechanism 26 in an embodiment is described in detail below with reference to FIG. 6. The centrifugal tripping mechanism 26 is disposed on a back side of the main pulley 231, that is, between the main pulley 231 and the first support 33. The centrifugal tripping mechanism 26 includes a core ring 262 which is fixedly connected to the first axle 21, for example, by using a key (not shown). The centrifugal tripping mechanism 26 further includes a centrifugal tripping member 261, wherein the centrifugal tripping member 261 rotates with the main pulley 231, enables the main pulley 231 and the core ring 262 to trip each other when a rotating speed of the main pulley 231 exceeds a preset value, and enables the main pulley 231, the core ring 262, and the first axle 21 coupled to the core ring 262 to rotate together. The centrifugal tripping member is known in the art. In some embodiments, the centrifugal tripping member 261 may use a type recorded in US patent No. US2013/0098711, which is disclosed on Apr. 25, 2013 and granted to OTIS; or reference may be made to a centrifugal tripping member type recorded in US patent No. US2015/0136544, which is disclosed on May 21, 2015 and granted to OTIS. Full texts of the two patents are quoted herein.

Figure 7:
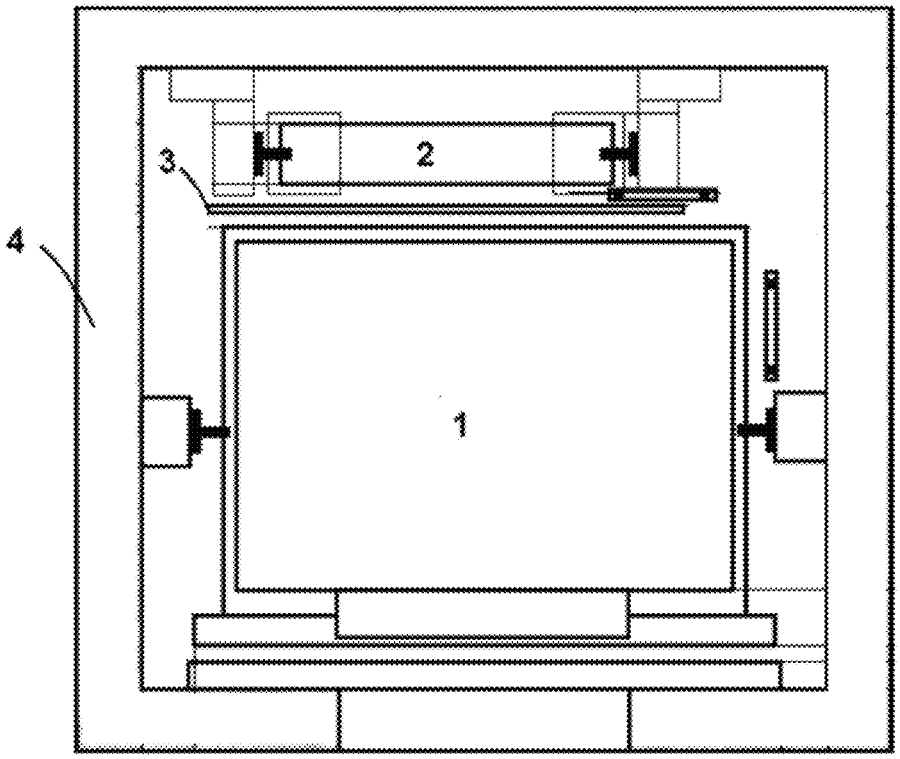
FIG. 7 illustrates a sectional view of a shaft.
Figure 8:
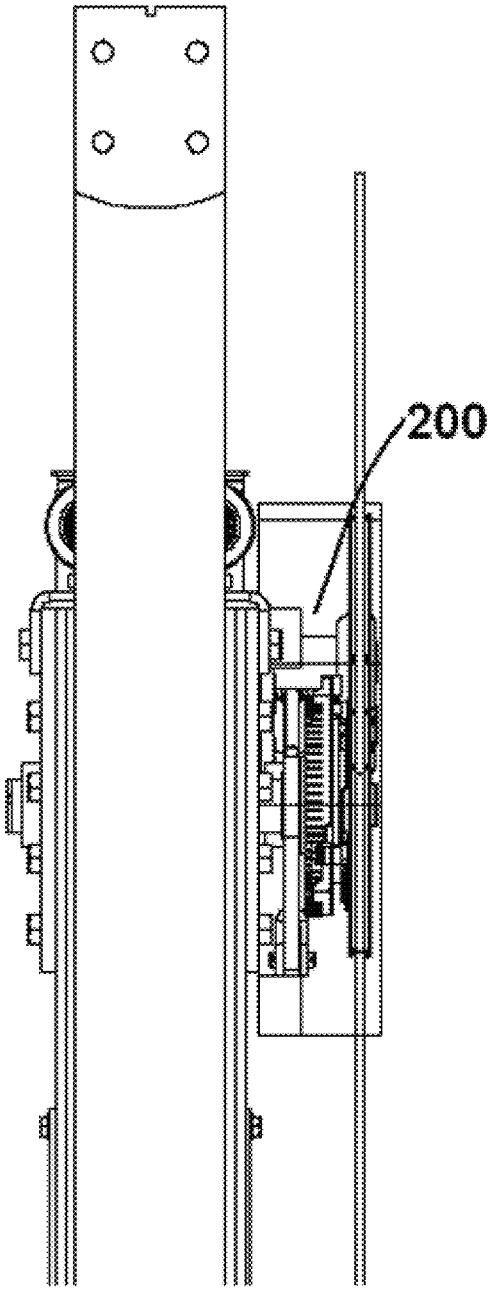
FIG. 8 illustrates a side view of a governor assembly disposed at a counterweight side of an elevator according to an embodiment of the present invention.

Refer to FIG. 7, which illustrates a sectional view of a shaft. The shaft is defined by a boundary 4, and is partitioned into a car side and a counterweight side by a partition plate 3. Generally speaking, because a car 1 needs to carry passengers, the shaft at the car side is larger so as to accommodate multiple types of governors. It can be seen from FIG. 7 that, the counterweight side in which a counterweight block 2 is disposed has a small space, and especially, a distance from the counterweight block 2 to the partition plate 3 is generally less than 150 mm. As shown in FIG. 8, the governor assembly 200 in the embodiment of the present invention may be compactly integrated with the counterweight side of the elevator, and merely the thickness and height of the top of the counterweight rack at the counterweight side are slightly increased, for example, the thickness is increased by about 100 mm and the height is increased by about 90 mm. A follower-type governor can be mounted at the counterweight side or the car side due to such a compact design.

It should be understood that, all of the above preferred embodiments are exemplary rather than restrictive. Various changes or modifications made by persons skilled in the art to the foregoing specific embodiments within the concept of the present invention shall fall within a legal protection scope of the present invention.

What is claimed is:

1. A governor assembly, comprising:

a support;

a first axle rotatably supported by the support;

a main pulley rotatably mounted on the first axle relative to the first axle;

a first guide pulley near the main pulley;

a first safety device actuated by the rotation of the first axle, wherein the first safety device comprises at least one swing arm fixedly connected to the first axle; and a centrifugal tripping mechanism which enables, when a rotating speed of the main pulley exceeds a preset value, the main pulley and the first axle to be coupled and rotate together;

wherein the support comprises a first support and a second support disposed opposite to each other at two sides of a guide rail;

wherein the first axle passes through the first support and the second support.

2. The governor assembly according to claim 1, wherein the centrifugal tripping mechanism comprises:

a core ring, fixedly connected to the first axle; and a centrifugal tripping member, wherein the centrifugal tripping member rotates with the main pulley, and when a rotating speed of the main pulley exceeds a preset value, enables the main pulley and the core ring to trip each other and rotate together.

3. The governor assembly according to claim 2, wherein the core ring is fixedly connected to the first axle by using a key.

4. The governor assembly according to claim 1, wherein the first axle is disposed to be substantially perpendicular to a guide rail plane defined by the guide rail.

5. The governor assembly according to claim 1, wherein the first support and/or the second support is selected from a tablet support, a tripod, a rod support, a railing support, or a net support.

6. The governor assembly according to claim 1, wherein the first axle comprises a middle portion located between the first support and the second support, and an end portion extending from the first support; and the first safety device is connected to the middle portion of the first axle and the main pulley is rotatably supported on the end portion of the first axle.

7. A governor assembly, comprising:

a support;

a first axle rotatably supported by the support;

a main pulley rotatably mounted on the first axle relative to the first axle;

a first guide pulley near the main pulley;

a first safety device disposed near a first guide rail actuated by the rotation of the first axle, wherein the first safety device comprises at least one swing arm fixedly connected to the first axle; and a centrifugal tripping mechanism which enables, when a rotating speed of the main pulley exceeds a preset value, the main pulley and the first axle to be coupled and rotate together;

a second safety device disposed near a second guide rail, the second safety device is actuated by the rotation of a second axle, and the second axle moves jointly with the first axle by using a connecting rod mechanism.

8. The governor assembly according to claim 7, wherein the connecting rod mechanism comprises a first arm, a connecting rod, and a second arm.

9. The governor assembly according to claim 7, wherein the second axle is rotatably supported by the first support and the second support; the second axle comprises a middle portion located between the first support and the second support, and an end portion extending from the first support; and the connecting rod mechanism is connected between the end portions of the first axle and the second axle.

10. The governor assembly according to claim 1, wherein the first guide pulley is located at one side of the main pulley and is higher than the main pulley.

11. The governor assembly according to claim 1, wherein the main pulley is disposed near a first guide rail; and the governor assembly further comprises a second guide pulley which is disposed near a second guide rail.

12. The governor assembly according to claim 1, further comprising a housing at least partially covering the main pulley and the first guide pulley.

13. A governor assembly, comprising:

a support;

a first axle rotatably supported by the support;

a main pulley rotatably mounted on the first axle relative to the first axle;

a first guide pulley near the main pulley;

a first safety device actuated by the rotation of the first axle; and a centrifugal tripping mechanism which enables, when a rotating speed of the main pulley exceeds a preset value, the main pulley and the first axle to be coupled and rotate together;

wherein the first safety device comprises:

at least one swing arm, of which a first end is fixedly connected to the first axle and a second end is located near a guide rail;

a pull rod suspending from the second end of the at least one swing arm; and an engaging member at the bottom of the pull rod;

wherein the pull rod is driven by the rotation of the swing arm to pull the engaging member, and then the engaging member is frictionally engaged with the guide rail.

14. The governor assembly according to claim 13, wherein the first safety device comprises two swing arms, pull rods connected to the two swing arms suspend from two sides of the first guide rail, and engaging members at the bottoms of the two swing arms are frictionally engaged with the guide rail at the two sides of the guide rail.

15. A governor assembly, comprising:

a first support and a second support disposed at two sides of a guide rail;

a first axle rotatably supported by the first support and the second support, wherein the first axle comprises a middle portion located between the first support and the second support, and an end portion extending from the first support, wherein the first axle passes through the first support and the second support;

a main pulley rotatably supported on the end portion of the first axle relative to the first axle;

a first guide pulley located near the main pulley;

a first safety device, connected to the middle portion of the first axle and actuated by the rotation of the first axle; and a centrifugal tripping mechanism, which enables, when a rotating speed of the main pulley exceeds a preset value, the main pulley and the first axle to be coupled and rotate together, wherein the main pulley and the first guide pulley are disposed at an outer side of the first support adjacent to the first support.

16. The governor assembly according to claim 15, characterized in that:

a core ring, which is fixedly connected to the first axle; and a centrifugal tripping member, which rotates with the main pulley, and when a rotating speed of the main pulley exceeds a preset value, enables the main pulley and the core ring to trip each other and rotate together.

17. The governor assembly according to claim 15, further comprising:

a second axle, which is rotatably supported by the first support and the second support, and comprises a middle portion located between the first support and the second support, and an end portion extending from the first support;

a connecting rod mechanism, connecting the end portions of the first axle and the second axle, so that the first axle and the second axle move jointly; and a second safety device which is connected to the middle portion of the second axle and actuated by the rotation of the second axle.

18. The governor assembly according to claim 15, further comprising a second guide pulley, wherein the second guide pulley is disposed near a second guide rail.

19. An elevator, configured with the governor assembly according to claim 1.

20. The elevator according to claim 19, wherein the governor assembly is disposed at a car side.

21. The elevator according to claim 19, wherein the governor assembly is disposed at a counterweight side.

* * * * *